United States Patent [19]

O'Hern, Jr.

[11] 4,338,793

[45] Jul. 13, 1982

[54] ADAPTER FOR REFRIGERATION SYSTEM ACCESS VALVE

[76] Inventor: James E. O'Hern, Jr., 1359 Sanden Ferry Dr., Decatur, Ga. 30033

[21] Appl. No.: 65,577

[22] Filed: Aug. 10, 1979

[51] Int. Cl.[3] ..... F25B 45/00

[52] U.S. Cl. ..... 62/292; 251/149.6; 137/231; 137/614.05; 62/149; 141/348

[58] Field of Search ..... 62/292, 149, 77; 251/149.6; 141/348, 311; 137/614.05, 614, 231

[56] References Cited

U.S. PATENT DOCUMENTS

| | | | |
|---|---|---|---|
| 3,712,336 | 1/1973 | Bell, Jr. | 137/231 |
| 3,976,110 | 8/1976 | White | 137/614.05 |
| 3,996,765 | 12/1976 | Mullins | 62/292 |
| 4,148,198 | 4/1979 | Kregoski | 62/292 |

*Primary Examiner*—Albert J. Makay
*Assistant Examiner*—Henry Bennett
*Attorney, Agent, or Firm*—Harvey B. Jacobson

[57] ABSTRACT

An adapter for connection with the access valve fitting of a closed refrigeration system which includes a screw threaded coupling engaged with the externally threaded nipple on the refrigeration system with the adapter including a screw threaded adjustable abutment member in a normally open passage for automatically opening the normally closed "Schrader" valve with the adapter itself including a duplicate "Schrader" valve oriented in perpendicular relation to the axis of the existing "Schrader" valve and perpendicular to the longitudinal axis of the adapter itself with the adapter also including threaded fittings enabling connection with a pressure gauge, hose, closure cap, or the like. The adapter is constructed of conventional components except for the adjustable abutment assembly which enables it to be inexpensively constructed and left permanently on a refrigeration system which enables service personnel to gain access to the refrigeration system through the duplicate "Schrader" valve which can be oriented in a more accessible position than the original equipment "Schrader" valve.

2 Claims, 2 Drawing Figures

ADAPTER FOR REFRIGERATION SYSTEM ACCESS VALVE

BACKGROUND OF THE INVENTION

1. Field of the Invention

The present invention generally relates to an adapter to be associated with a closed refrigerating system and more specifically an adapter to enable a duplicate access valve to be associated with the refrigerating equipment so that access may be more easily gained to the refrigerating system with the adapter including an abutment which actuates the existing access valve on the refrigerating equipment.

2. Description of Relevant Art

Existing refrigerating systems used in refrigerators, freezers, air conditioners and many other devices conventionally are provided with an access valve, generally referred to as a "Schrader" valve which is, in effect, a spring biased check valve normally closed through which refrigerant can be supplied to the refrigerating system. In the servicing of refrigeration equipment, it has become customary to provide service personnel with a rather sophisticated manifold arrangement which can be temporarily attached to the service fitting with such devices including a movable cam or other type of actuator to open and close the existing access valve from a position externally of the manifold. The following U.S. patents are relevant to this field of endeavor.

U.S. Pat. No. 2,614,400—Oct. 21, 1952—May
U.S. Pat. No. 3,424,181—Jan. 28, 1969—Morse
U.S. Pat. No. 3,645,496—Feb. 29, 1972—Rawlins
U.S. Pat. No. 3,875,756—Apr. 8, 1975—Olson
U.S. Pat. No. 3,916,641—Nov. 4, 1975—Mullins
U.S. Pat. No. 3,916,947—Nov. 4, 1975—Holmes et al
U.S. Pat. No. 3,996,765—Dec. 14, 1976—Mullins
U.S. Pat. No. 4,069,686—Jan. 24, 1978—Hoelman.

SUMMARY OF THE INVENTION

An object of the present invention is to provide an adapter for installation on a closed refrigerating system which includes a duplicate access valve and an abutment for actuating the existing access valve in the refrigeration equipment.

Another object of the present invention is to provide an adapter, in accordance with the preceding object, in which the abutment is longitudinally, screw threadedly adjustably mounted in the adapter in order for it to be accurately positioned so that it will not open the existing access valve until the adapter has been at least partially screw threadedly connected to the externally threaded nipple on the refrigerating equipment in which the "Schrader" valve is mounted.

A further object of the present invention is to provide an adapter constructed of standard and readily available components, except for the screw threaded adjustment mechanism, which enables the adapter to receive gauges, hoses, and the like, and provides a mounting for a duplicate "Schrader" valve spaced from and angularly related to the original "Schrader" valve thereby providing a duplicate access valve spaced from the original access valve which can be positioned in a more accessible position thereby enabling service personnel to more readily service the refrigerating system.

Still another important object of the present invention is to provide an adapter in accordance with the preceding objects which is quite inexpensive to manufacture thereby enabling it to be permanently installed in a refrigeration apparatus, or the like, so that it will be available to service personnel when there is a necessity to service the particular refrigerating system without the service personnel having to attach a service manifold or other rather sophisticated structure which must be carried to the site of the refrigeration system each time service operations are to be performed.

Yet another important object of the present invention is to provide an adapter in accordance with the preceding objects which is quite easy to install and substantially foolproof in operation and quite safe since there will be very little, if any, escape of refrigerant since the orientation of the abutment is such that connection of the adapter to the access valve fitting will be at least partially complete before the access valve is opened.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
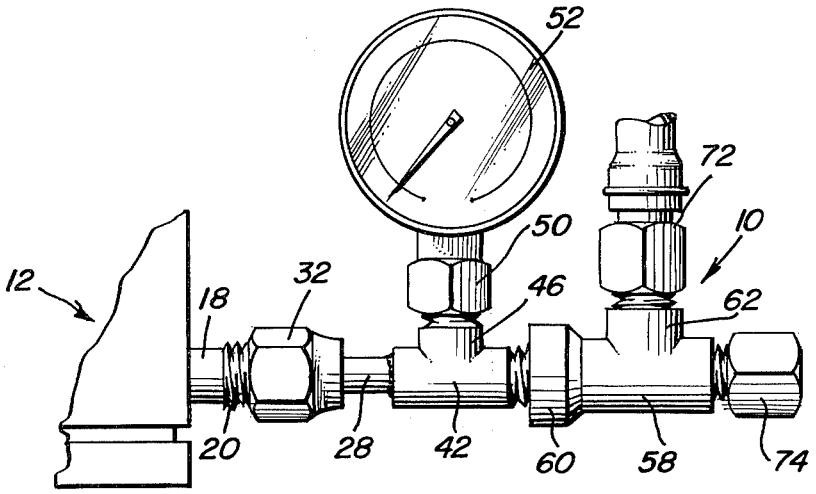
FIG. 1 is an elevational view of the adapter of the present invention attached to the access valve nipple of an existing refrigerating system or refrigeration equipment.

Referring now specifically to the drawings, the adapter of the present invention is generally designated by numeral 10 and is illustrated as being mounted on a conventional existing refrigeration equipment generally designated by the numeral 12 which includes an access valve nipple 18 having external threads 20 and receiving internally thereof an access valve or "Schrader" valve 22 which is screw threaded into the internal threads 24 thereon in a conventional and well-known manner with the operating stem 26 of the valve 22 being disposed adjacent the outer end of the nipple 18 in a manner well-known in this art. Normally, the nipple 18 is provided with a removable internally threaded cap which forms a protection for and sealed closure for the nipple 18 and it is through this structure that access is obtained to the refrigeration equipment 12 in a manner well understood in this art. For example, the nipple 18 may communicate with the suction side of a refrigeration compressor to enable refrigerant to be supplied to the refrigeration system through the nipple 18 and valve 22.

The adapter 10 includes a longitudinally extending tubular member 28 which may be a copper tube and includes a peripheral flare or bell 30 at one end receiving a rotatable coupling member 32 thereon which is internally threaded as at 34 so that it will be screw threaded into engagement with the external threads 20 on the nipple 18 so that the tubular member 28 is in alignment therewith and sealed thereto when completely coupled.

Figure 2:
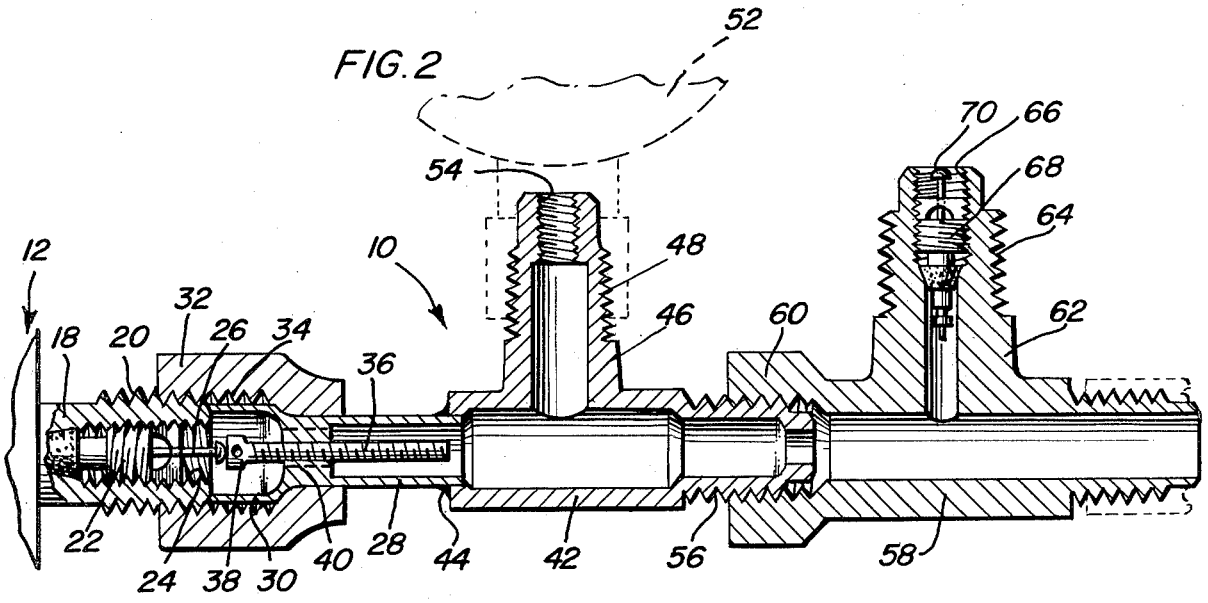
FIG. 2 is a longitudinal, vertical sectional view, on an enlarged scale, illustrating the structural details of the adapter of the present invention.

Mounted longitudinally in the tubular member 28 is an externally threaded longitudinally adjustable member 36 which, at the end disposed adjacent to the operating stem 26, is provided with an enlargement in the form of an abutment 38 with the adjustment of the member 36 enabling the abutment 38 to be positioned so that it will engage and depress the operating stem 26 when the coupling 32 is threaded onto the nipple 18 with the orientation of the components being such that the abutment 38 will not operate the stem 26 of the valve 22 until the coupling member 32 is at least partially engaged with the threaded nipple 18. The threaded member 36 is supported by internal threads on the tubular member 28 with the threaded enlargement of the tubular member 28 adjustable member 36 being loose fitting to provide a passageway communicating with the interior of the threaded nipple 18 and the interior of a standard T-coupling or T-fitting 42 which is connected to the tubular member 28 such as by soldering 44, or the like, as illustrated in FIG. 2. Alternatively, a passageway communicating through a spider 40 may communicate between the interior of the threaded nipple 18 and the interior of the T-fitting 42 without the threaded member 36 precluding flow through the tubular member. The branch of the T-fitting 42, as designated by numeral 46, is externally threaded, as at 48, for receiving the internally threaded fitting 50 forming a base portion of a pressure gauge 52 or alternatively, a closure cap may be provided on the branch 46. Also, the interior of the branch 46 may be provided with internal threads 54 duplicative of the internal threads 24 to enable a duplicate "Schrader" valve to be positioned in this branch when desired, such as when a supply hose or the like may be connected thereto rather than the gauge 52 as illustrated. The main portion of the T-fitting 42 is provided with an externally threaded nipple 56 which is screw threaded with another T-fitting 58 having a belled end 60 which is internally threaded and in threaded engagement with the nipple 56. The T-fitting 58 also includes a branch 62 which is externally threaded, as at 64, and internally threaded, as at 66, for receiving a duplicate "Schrader" valve 68 of conventional construction with the "Schrader" valve 68 including an operating stem 70 positioned adjacent the end of the branch 62, as illustrated in FIG. 2, so that a conventional supply hose 72 or other device may be connected thereto which includes a device for opening the valve 68 when so connected in order to supply refrigerant to the refrigeration equipment 12. Also, the T-fitting 58 is provided with an externally threaded longitudinal nipple 72 to which may be attached a cap 74 or other device to be communicated with the refrigeration system.

In using this device, the normally provided closure and protective cap on the nipple 18 is removed and the adapter 10 of the present invention is permanently attached to the nipple 18. As the coupling member 32 is screw threaded onto the nipple, the abutment 38 will engage and open the "Schrader" valve 22. The adapter 10 is closed by the duplicate "Schrader" valve 68 and a gauge or cap on the branch 46 of the T-connection or fitting 42 and a closure cap 74 or other structure on the externally threaded end of the T-fitting 58. After the adapter has been installed, the service person may easily perform various functions such as supplying refrigerant to the system through the access valve 68 by a conventional recharging hose and pressurized supply of refrigerant in a well-known manner. This adapter enables the duplicate access valve 68 to be oriented in a substantially more accessible position as compared to the conventional access valve 22. By constructing the device of standard T-fittings which have only been slightly modified, the cost of the adapter is maintained at a minimum, thereby rendering it economically feasible to leave the adapter permanently mounted on the refrigerating equipment rather than requiring a service person to bring with him a manifold to be attached to the existing access valve which frequently is located in an inacessible position, such as in a remote area of a housing mounted on top of a roof, or the like, of a building. Thus, with the adapter of the present invention, the servicing of a refrigeration system may be more expediently carried out by service personnel and actually enabling service personnel with less skill to properly perform service on refrigeration equipment.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a refrigeration system having an access valve which includes a valve stem connected to a valve member for actuation thereof, an adapter comprising a tubular member having a flow passage therethrough, bell-shaped means on one end of the tubular member for achieving alignment during coupling of the tubular member to the access valve, an abutment mounted in the tubular member engaging the valve stem to actuate the valve stem to open the access valve when the tubular member is coupled to the access valve, said abutment including a longitudinally extending threaded member, threadedly engaged with a portion of the interior of the tubular member to vary the longitudinal position of the abutment in relation to the tubular member thereby enabling the abutment member to be adjusted so that the tubular member will be at least partially coupled to the access valve before the abutment actuates the valve stem, said abutment being completely enclosed by the tubular member and inaccessible from a position exteriorly of the tubular member when the tubular member is connected to the access valve, said flow passage through the tubular member remaining continually open during adjustment of the abutment and movement of the access valve and means on said tubular member for communication with a refrigeration supply assembly to supply refrigeration through the tubular member and access valve into the refrigeration system, said access valve being externally threaded, said bell-shaped coupling means on the tubular member including an internally threaded coupling member for coupling the tubular member to the access valve with the axis of the tubular member being aligned with the access valve, said valve stem being disposed centrally of the access valve and the abutment being oriented along the longitudinal axis of the tubular member in alignment with the valve stem, said means on the tubular member for communication with a refrigeration supply assembly including at least one fitting having a laterally extending branch which is externally threaded for coupling with a refrigerant supply means, said branch being internally threaded, and a valve means duplicative of the access valve in the internally threaded portion of the branch for actuation to an open position when the refrigerant supply assembly is connected thereto.

2. An adapter for connection with an access valve of a refrigeration system in which the access valve is positioned in an externally threaded nipple and includes a longitudinally reciprocal valve stem, said adapter comprising a tubular member having a peripherally flared portion at one end thereof so that the tubular member is placed in alignment and sealed onto the externally threaded nipple, an uninterrupted flow passage through the tubular member, a screw threaded coupling member at said one end thereof encompassing the peripherally flared portion for screw threaded engagement with the externally threaded nipple on the refrigeration system, said tubular member including means spaced from the coupling member for communication with a charging assembly for the refrigeration system, an abutment in said tubular member for engaging and moving the access valve stem to open position when the tubular member is coupled to the nipple, said abutment including a longitudinally extending externally threaded member threadedly mounted in the tubular member for longitudinal adjustment of the abutment in relation to the tubular member only when the tubular member is not connected to the access valve and without precluding flow through the tubular member thereby enabling the position of the abutment to be adjusted so that the coupling member on the tubular member will be at least partially engaged with the externally threaded nipple before the access valve stem is moved to open position, said means for communication with the charging assembly including a duplicate access valve having its axis mounted in substantially perpendicular relation to the longitudinal axis of the tubular member, said tubular member having the axis of its uninterrupted flow passage being generally in alignment with the axis of the existing access valve in the nipple with the axis of the duplicate valve also being generally perpendicular to said axis of the access valve in the nipple, said tubular member including two T-fittings with one of the T-fittings being fixedly attached to the end of the tubular member remote from the nipple and the second T-fitting being threadedly connected to the first T-fitting thereby providing a relatively inexpensively constructed adapter which can be permanently mounted on the refrigeration equipment so that service personnel will not have to carry a manifold with them when servicing refrigeration equipment which may have substantially inaccessible access valves, said fittings including perpendicular branches which are externally threaded with one of the branches for receiving a pressure gauge and the other branch receiving the duplicate access valve with all of the fittings being capable of receiving closure caps for closing any passage through the fittings.

* * * * *